US006601638B1

(12) United States Patent
Lafleur

(10) Patent No.: US 6,601,638 B1
(45) Date of Patent: Aug. 5, 2003

(54) GATE

(76) Inventor: Arthur Lafleur, 3220 LaSalle Blvd., Sudbury, Ontario (CA), P3A 4R7

( * ) Notice: Subject to any disclaimer, the term of this patent is extended or adjusted under 35 U.S.C. 154(b) by 0 days.

(21) Appl. No.: 10/000,253

(22) Filed: Dec. 4, 2001

(30) Foreign Application Priority Data

Apr. 9, 2001 (CA) ..... 2343593

(51) Int. Cl.[7] ..... A47G 5/02
(52) U.S. Cl. ..... 160/242; 160/29
(58) Field of Search ..... 160/242, 273.1, 160/23.1, 24, 29

(56) References Cited

U.S. PATENT DOCUMENTS 502,460 A 8/1893 Haskins et al.
505,681 A * 9/1893 Starkwather
1,207,078 A * 12/1916 Robertson
1,230,269 A * 6/1917 Boch
1,329,929 A * 2/1920 Sandberg
1,338,168 A * 4/1920 Boch
2,747,927 A * 5/1956 Burkhead
4,194,550 A * 3/1980 Hopper
4,458,448 A 7/1984 Proulx
4,601,320 A * 7/1986 Taylor
4,825,921 A * 5/1989 Rigter

* cited by examiner

*Primary Examiner*—Blair M. Johnson

(57) ABSTRACT

A gate having a main gate post and an outer gate post spaced from the main gate post. A support arm is mounted on the main gate post and extends from it to the outer gate post. The support arm is on the post above the ground a sufficient distance to allow some access under it. A flexible gate panel extends down from a roller carried by the support arm to normally close the gate. Winding means are provided for winding up the gate panel on the roller to partly open the gate. The support arm, carrying the wound up gate panel, can be rotated from the outer gate post to fully open the gate.

14 Claims, 5 Drawing Sheets

GATE

BACKGROUND OF THE INVENTION

1. Field of the Invention

This invention is directed toward a gate. The invention is more particularly directed toward a gate having a gate panel that can be wound-up to partly open the gate, the wound-up gate panel swung open to fully open the gate if desired.

2. Description of the Related Art Including Information Disclosed Under CFR §§1.97–1.99

Gates are known where the main panel of the gate, closing the gate opening, can be swung open on a vertical hinge to open the gate. This is hard to do however if the passageway closed by the gate is covered in deep snow. Gates are also known where the main gate panel can be slid sideways or raised vertically to open the gate. Such gates can be more easily opened, even in deep snow. However, these gates require more room for the gate to be able to operate and also require additional supporting structure. Gates are known which can move sharply upwardly while swinging open. This type of gate, shown in U.S. Pat. 4,458,448, issued Jul. 10, 1984, Roland Proulx, inventor, opens quite easily in snow and does not take up a lot of room. However the mechanism used to open the gate is quite complicated and a higher supporting structure is also needed making the gate relatively expensive.

SUMMARY OF THE INVENTION

It is the purpose of the present invention to provide a relatively compact gate that is relatively simple to construct and operate; that does not require a lot of room, or supporting structure, when opening; and that works particularly well when snowed in.

In accordance with the present invention, a gate is provided having a gate panel that can be wound up to partly open the gate. If needed, the wound up gate panel can then swung open, fully opening the gate. Having a gate panel that winds up makes it easy to open the gate in deep snow. Being able to open the gate part way by winding up the gate panel allows small animals to pass through the opening under the wound up panel while the wound up panel prevents the passage of larger animals. The gate of the present invention is well suited for use by a person in a wheelchair. The person in the wheelchair can pass through the gate when the panel is wound up, passing under the wound up panel. The wound up panel can be easily swung open if larger animals, vehicles, or people walking, must pass through the gate.

The gate can be manually operated to both wind up the gate panel and to swing the wound up gate panel open. Preferably, the gate is mechanized and can have electric motors, operated by a remote control, or a control panel in a gate post, to both wind or unwind the gate panel and to swing the wound up gate panel between open and closed positions.

The invention is particularly directed toward a gate having a main gate post and a support arm mounted on the main gate post and extending from it a sufficient distance to span a passageway when the gate post is installed. The support arm is mounted on the post above the ground a sufficient distance to allow access under it through the passageway. A flexible gate panel extends down from the support arm to normally close the passageway. The gate has winding means for winding up the gate panel to the support arm to partly open the passageway.

In one embodiment, the main gate post is mounted by vertical pivot means on a ground support so that the main post, with the support arm carrying the wound up gate panel, can be rotated to swing the support arm generally horizontally between a closed position where it spans the passageway and an open position where it is swung away from the passageway to fully open the passageway.

In a second embodiment, the support arm is mounted by vertical pivot means on the main gate post so that the support arm, with the gate panel wound up, can be swung generally horizontally between a closed position where it spans the passageway and an open position where it is swung away from the passageway to fully open the passageway.

DESCRIPTION OF THE PREFERRED EMBODIMENTS

Figure 1:
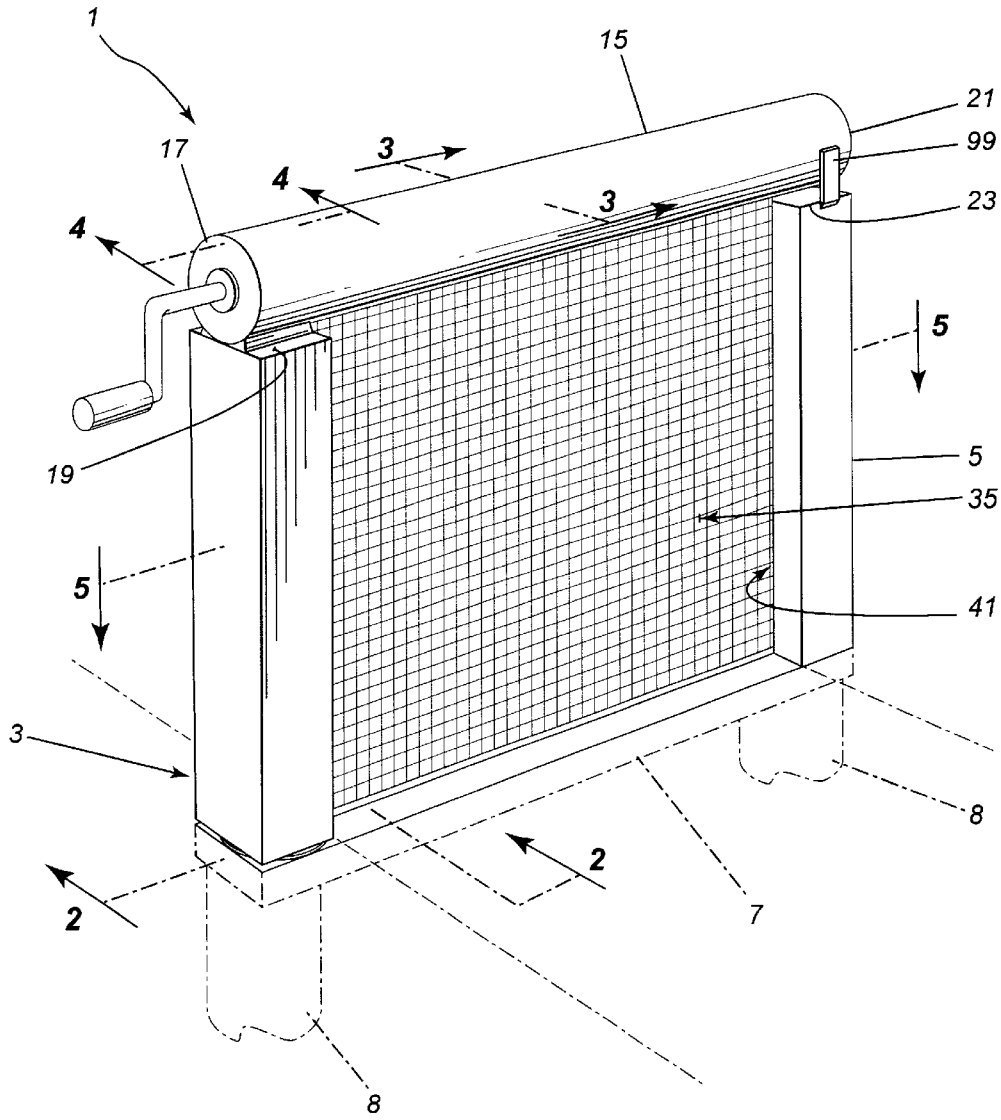
FIG. 1 is a perspective view of the gate in a closed position.
Figure 2:
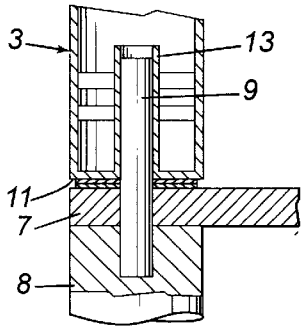
FIG. 2 is a partial cross-section view taken along line 2—2 in FIG. 1.

The gate 1 of the present invention, as shown in FIG. 1, has a main gate post 3, adjacent one side of a passageway P and an outer gate post 5, spaced from the main gate post 3 by a ground support member 7, on the other side of the passageway. The two gate posts 3, 5 are vertical and mounted on the ground support member 7 which can be set in the ground, traversing the passageway, so its top surface is flush with the ground surface. Preferably, the ground support member 7 is fixedly mounted on two in-ground support means in the form of concrete posts 8, one under each gate post 3, 5. The outer gate post 5 is fixedly mounted on the support member 7 while the main gate post 3 is rotatably mounted thereon, as shown in FIG. 2, via a pivot pin 9 extending upwardly from one of the concrete posts 8 through the support member 7 and the bottom end 11 of the main gate post 5 into a socket 13 therein. Suitable means (not shown) detachably retain the pin 9 in the socket 13.

A support arm 15 is mounted at one end 17 on the main gate post 3. The support arm 15 is mounted on the main gate post 3 at a height sufficient to allow partial access under it over the passageway P. Preferably, the support arm 15 is mounted on the top 19 of the main gate post 3. The support arm 15 extends horizontally across to the outer gate post 5 and its outer end 21 preferably rests on the top 21 of the post 5. The support arm 15 preferably is a tubular member.

Figure 3:
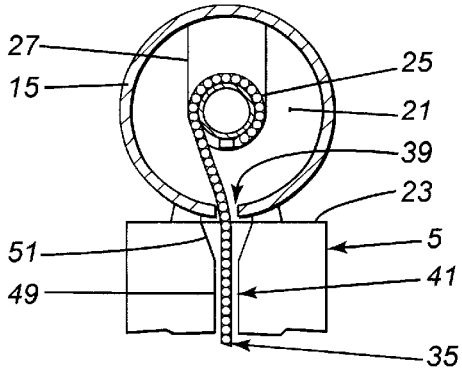
FIG. 3 is a partial cross-section view taken along line 3—3 in FIG. 1.
Figure 4:
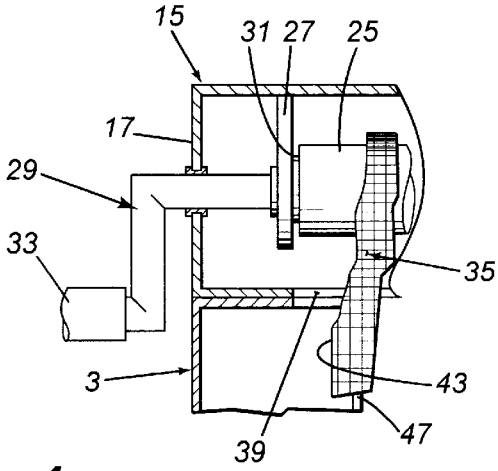
FIG. 4 is a cross section view taken along line 4—4 in FIG. 1.

The support arm 15 carries a roller 25 rotatably supported at its ends to brackets 27 fixed near the ends 17, 21 of the support arm, as shown in FIGS. 3 and 4. The roller 25 is located within the arm 15 and protected by it. First rotation means 29 are connected to one end 31 of the roller 25 for rotating it. The rotation means 29 can comprise a hand crank 33 extending out through the one end 17 of the support arm 15 and detachably connected to the one end 31 of the roller 25 within the support arm 15.

Figure 5:
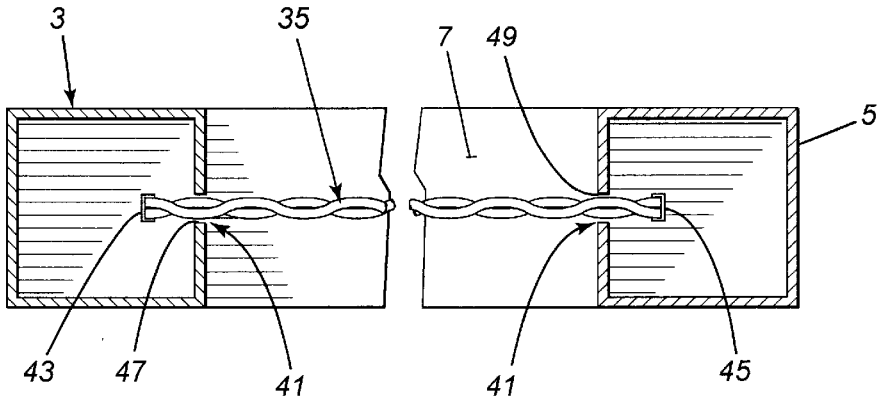
FIG. 5 is a cross section view taken along line 5—5 in FIG. 1.
Figure 6:
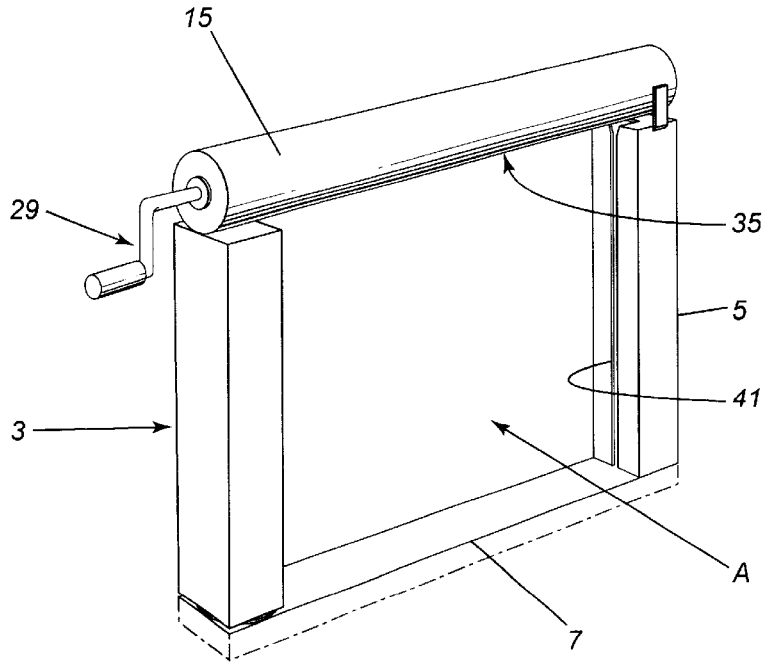
FIG. 6 is a perspective view similar to FIG. 1 but showing the gate partly open.
Figure 7:
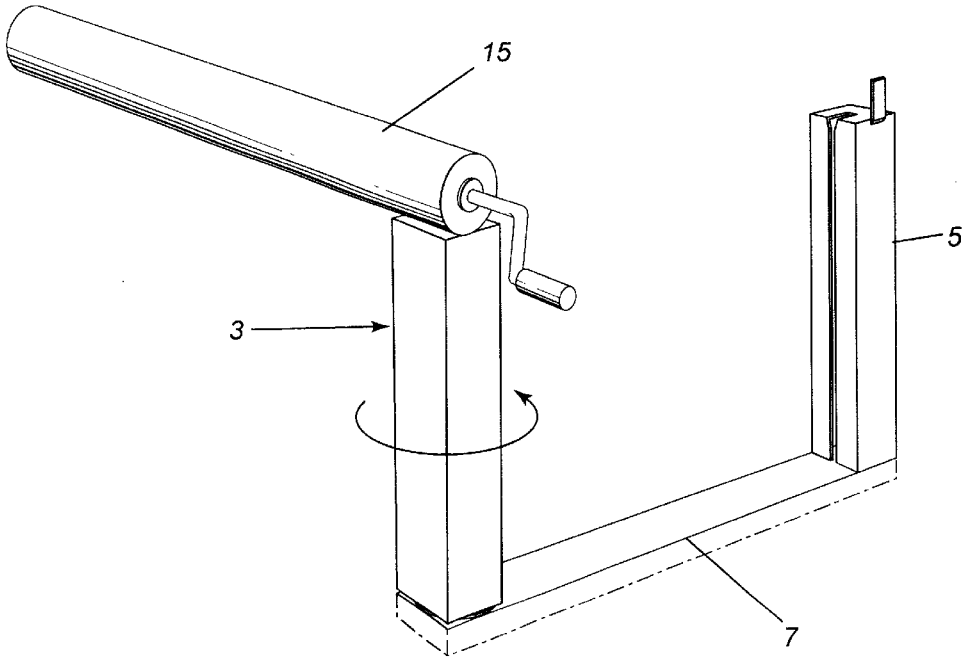
FIG. 7 is a perspective view similar to FIG. 1 but showing the gate fully open.

A flexible gate panel 35 is mounted along its top end to the roller 25. The gate panel 35 is made of suitable flexible material, such as plastic or a fine metal mesh, and normally hangs down from its attachment to the roller 25, through a bottom slot 39 in the bottom of the support arm 15, to fill the space between the gate posts 3, 5 under the support arm 11. Preferably, there are facing guide means 41 on the inner sides of the gate posts 3, 5, as shown in FIG. 5, which guide the gate panel 35 by its side edges 43, 45. The guide means 41 can comprise vertical slots 47, 49 on the posts 3, 5 respectively, the slots 47, 49 facing each other, with the edges 43, 45 of the panel within the slots 47, 49 as the panel is lowered from the support arm 15 by unwinding it off the roller 25. The top ends of the slots 47, 49, adjacent the bottom slot 39 in the support arm 15 can be widened slightly as shown at 51 to allow entry of the gate panel 35 into the slots 47, 49. Rotation of the crank 33 in one direction will raise the gate panel 35, winding it on the roller 25 until it clears the guide means 41 to partly open the gate as shown in FIG. 6. Small animals such as sheep or goats, or a person in a wheelchair, can pass through the opening A created in the partly open gate under the wound up gate panel 35. If something larger than the opening A is to pass the through the gate, then the main gate post 3, carrying the support arm 15 and the wound up gate panel 35, can be manually rotated via the pivot 9, swinging the support arm 15 away from the outer gate post 5 to fully open the gate as shown in FIG. 7. The gate is partly closed from a fully open position by rotating the main gate post 5 back thus swinging the support arm 15 back to rest on the outer gate post 5. Lowering the gate panel 35 completes closure of the gate.

Figure 8:
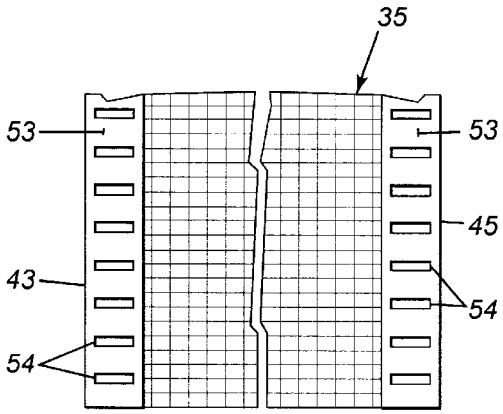
FIG. 8 is a partial front view of a modified gate panel.
Figure 9:
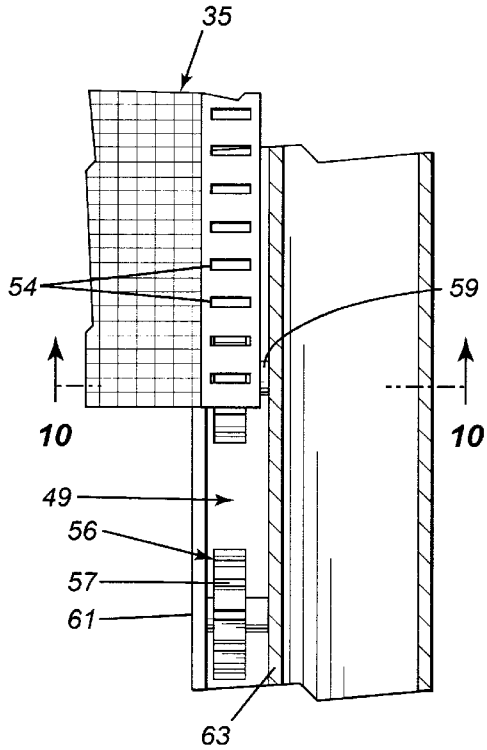
FIG. 9 is a partial cross-section view of a modified gate post with the gate panel in a partially closed position.
Figure 10:
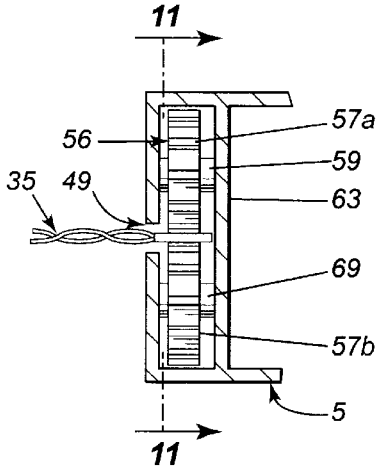
FIG. 10 is a cross-section view taken along line 10—10 in FIG. 9.
Figure 11:
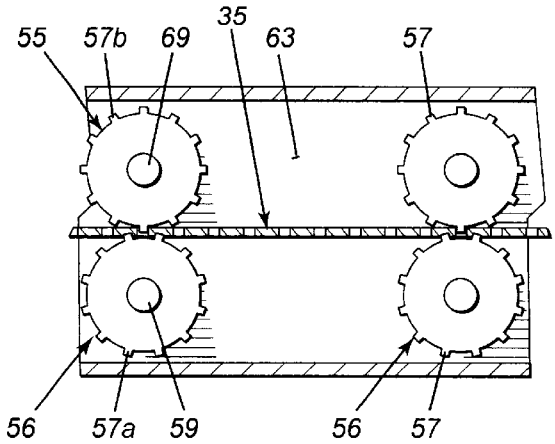
FIG. 11 is a cross-section view taken along line 11—11 in FIG. 10

The gate can work satisfactorily as described. It is preferred however to have the edges 43, 45 of the gate panel 35 securely retained, by suitable retaining means, within the slots 47, 49 on the posts 3, 5 when unrolled. To this end, each edge portion of the gate panel adjacent an edge 43, 45 is reinforced with a strip 61 of strong yet flexible material, and this strip 61 is, along with the gate panel, perforated with a row of perforations 63 as shown in FIG. 8. Mounted in each post 3, 5 is a set of pairs of rotatable sprockets 57. Each sprocket set has vertically spaced apart pairs of sprockets. Each sprocket pair has one sprocket rotatably mounted on one side of a slot and the other sprocket of the pair rotatably mounted on the other side of the slot, the two sprockets engaging within the slot. Thus as shown in FIGS. 9 to 11, one sprocket 57*a* is rotatably mounted on a shaft 59 which shaft is fixedly mounted between the outer wall 61 of post 3 and an inner wall 63, parallel to the outer wall 61. The shaft 59 is mounted between the walls 61, 63 to allow the sprocket 57*a* to project into the slot 47. A second sprocket 57*b* is rotatably mounted on a shaft 69 which shaft is fixedly mounted between the outer wall 61 of post 3 and the inner wall 63 on the other side of the slot 47. The shaft 69 is parallel to shaft 59. The second sprocket 57*b* projects into the slot 47 to engage the sprocket 57*a*. Each pair of sprockets in the post 3 are similarly mounted as are each pair of sprockets in the set in the other post 5 relative to its slot 49. Each pair of sprockets freely rotate. As the gate panel 35 is moved down between the slots 47, 49, the strips 61 on the edges 43, 45 of the panel 35 pass between the sprockets 57*a*, 57*b*, the teeth on the sprockets interengaging through the openings 63 in the strips, as shown in FIG. 11. The interengaging sprocket pairs on the posts 3, 5 cooperate with the perforations in the edges of the gate panel 35 to provide the retaining means that serve to hold the panel in the slots 47, 49 to keep the gate closed by the panel 35.

Figure 12:
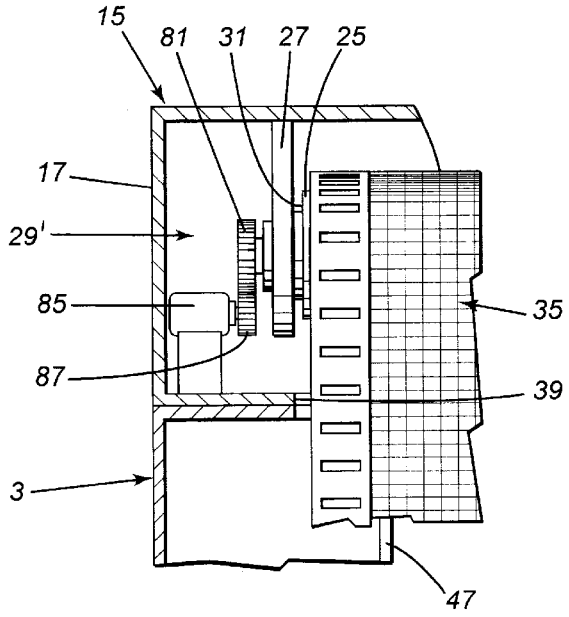
FIG. 12 is a partial cross-section view similar to FIG. 4, but with the gate mechanized.

The gate can be mechanized. The first rotation means 29 can be motorized, dispensing with the hand crank 33, and includes a driven gear 81 at one end 83 of the roller 25 as shown schematically in FIG. 12. The motorized rotation means 29 includes a small, first, reversible motor 85 mounted in the one end 17 of the support arm 15. The first motor 85 drives a drive gear 87 which is connected to the driven gear 81 on the roller 25 to rotate the roller 25 in either direction depending on the direction the motor 53 is driven. Other suitable motor and gear drive means can used can be used to rotate the roller 25 in either direction.

Second rotation means 91 can be provided on the main gate post 3 for mechanically rotating the post 3 about the pivot pin 9. The second rotation means 91 can be motor driven as well and can comprise a second small motor 93 mounted in the main gate post 3 as shown schematically in FIG. 13. A gear 95 driven by the second motor 93 rotates on a gear 97 connected to the pin 9' to rotate the post 3, via its socket 13', when operated. When the gear 95 is rotated in one direction, the post 3 rotates about the pin 9' moving the arm 15 off the outer gate post 5 and fully opens up the gate carrying the rolled-up gate panel 31 with it. When the motor 93 is reversed and rotates the post 3 in the opposite direction, the post 3 moves the support arm 15 back onto the post 5 to partly close the gate. Other suitable motor and gear drive means can be used. A stop 99 can be provided on the top of the outer gate post 5, as shown in FIG. 1, to stop movement of the support arm 15 when it reaches the top of the gate post 5 with the slot 39 therein aligned with the guide means 41.

The motors 85, 93 can be operated by remote control to both wind-up the gate panel 35 into the support arm 15 to partly open the gate, and to then swing the support arm 15 open, carrying the wound-up gate panel 35 with it, to fully open the gate. Alternatively, control buttons (not shown) can be provided on the main gate post 3, operated by the person wishing to use the gate, to control the operation of the two motors 85, 93 to open and close the gate. The motors 85, 93 and control buttons can be connected to a power source by suitable means (not shown).

Figure 13:
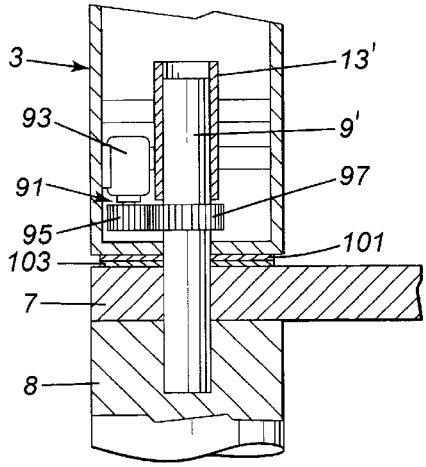
FIG. 13 is a partial cross-section view similar to FIG. 2, but with the gate mechanized.

Bearing means, such as a pair of abutting circular plates, can be provided, one 101 fixed to the bottom of the main gate post 3 and one 103 fixed to the top of the support member 7, as shown in FIG. 13, to allow easy rotation of the post 3 and thus easy swinging of the support arm 15.

Figure 14:
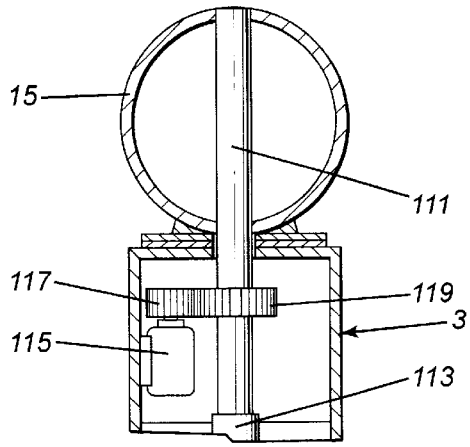
FIG. 14 is a partial cross-section view through the bottom of the main post showing the bottom pivot means for the main post.

While the support arm 15 has been shown as being fixed to the main gate post 3 and the main gate post rotatable to swing the arm, the arm could be rotatable attached to the top of the post 3 and the post 3 could be fixed to the support member 7. In this embodiment, as shown in FIG. 14, the arm 15 has a pivot pin 111 that projects down, the pin entering a socket 113 in the upper end of the post 3. If the gate is mechanized, a motor 115 can be mounted in the end of the arm. A gear 117 driven by the motor 115 will contact a gear 119 fixed to the pin 111 causing the arm 15 to rotate about the post 3. Other suitable motor and gear drive means can be provided to rotate the arm on the post.

Sensor means (not shown) can be provided to limit the movement of the support arm between open and closed positions, the sensor means shutting the second motor when the support arm is in position to fully open the gate or in position to partly close the gate in resting on top of the outer gate post 5. Sensor means (not shown) can also be provided to prevent operation of the second motor to open the support arm 15 if the gate panel 35 is not fully raised.

The gate has been shown with the gate posts mounted on a ground support member. They could however be mounted independently on individual supports set in the ground and the ground support member could be dispensed with. The gate has also been described with two gate posts. However, the gate could be employed in situations where only the main gate post is used. For example, the gate could be used with a fence post taking the place of the outer gate post or with the side of a building taking the place of the outer gate post.

I claim:

1. A gate having: a main gate post having a bottom end, the main gate post having a vertical pivot means at its bottom end to rotatably mount the main gate post on a ground support; a second gate post spaced from the main gate post across a passageway; a support arm mounted on the main gate post and extending from it to the second gate post to span the passageway when the gate posts are installed, the support arm on the main post above the ground a sufficient distance to allow access under it through the passageway; a flexible gate panel extending down from the support arm to normally close the passageway, the gate panel having side edges, the gate posts having guide means on their inner sides facing each other, the gate panel guided by its side edges in the facing guide means on the gate posts; winding means on the support arm for winding up the gate panel to partly open the passageway and to clear the second post; the main post, with the support arm carrying the wound up gate panel, rotatable on the bottom pivot means to swing the support arm generally horizontally between a closed position where it spans the passageway to the second gate post and an open position where it is swung away from the second gate post to fully open the passageway.

2. A gate as claimed in claim 1 wherein the winding means includes a roller carried by the support arm, the gate panel attached to the roller, and first rotating means for operating the roller to wind the gate panel thereon.

3. A gate as claimed in claim 2 wherein the first rotation means comprise a crank, supported by the support arm, and connected to the roller to rotate the roller manually to wind the gate panel on the roller.

4. A gate as claimed in claim 2 wherein the first rotation means includes a first motor mounted in the support arm adjacent one end of the roller, and gear means connecting the first motor to the roller to rotate the roller to wind the gate panel on the roller.

5. A gate as claimed in claim 2 including second rotation means on the main gate post for rotating the support arm on the pivot means between the open and closed positions.

6. A gate as claimed in claim 4 including second rotation means on the main gate post for rotating the main gate post, and thus the support arm, on the pivot means between the open and closed positions.

7. A gate as claimed in claim 1 including cooperating retaining means in the guide means on the posts and on the edges of the gate panel for retaining the gate panel between the posts when lowered from the support arm.

8. A gate as claimed in claim 7 wherein the cooperating retaining means comprise a set of pairs of sprockets in each post in the guide means, and perforations along the side edges of the gate panel through which each pair of sprockets, in each set, interengage.

9. A gate having: a main gate post having a top end; a second gate post spaced from the main gate post across a passageway; a support arm mounted on the top and of the main gate post and extending from it to the second gate post to span the passageway when the gate posts are installed, the support arm mounted by vertical top pivot means on the main gate post, the support arm on the main post above the ground a sufficient distance to allow access under it through the passageway; a flexible gate panel extending down from the support arm to normally close the passageway, the gate panel having side edges, the gate posts having guide means on their inner sides facing each other, the gate panel guided by its side edges in the facing guide means on the gate posts; winding means on the support arm for winding up the gate panel to partly open the passageway and to clear the second post; the support arm carrying the wound up gate panel, rotatable on the top pivot means to swing the support arm generally horizontally between a closed position where it spans the passageway to the second gate post and an open position where it is swung away from the second gate post to fully open the passageway.

10. A gate as claimed in claim 9 wherein the winding means includes a roller carried by the support arm, the gate panel attached to the roller, and first rotation means for operating the roller to wind the gate panel thereon.

11. A gate as claimed in claim 10 wherein the first rotation means includes a first motor mounted in the support arm adjacent one end of the roller, and gear means connecting the first motor to the roller to rotate the roller to wind the gate panel on the roller.

12. A gate as claimed in claim 10 including second rotation means on the main gate post for rotating the support arm, on the pivot means between the open and closed positions.

13. A gate as claimed in claim 9 including cooperating retaining means in the guide means and on the edges of the gate panel for retaining the gate panel between the posts when lowered from the support arm.

14. A gate as claimed in claim 13 wherein the cooperating retaining means comprise a set of pairs of sprockets in each post in the guide means, and perforations along the side edges of the gate panel through which each pair of sprockets in each set interengage.

* * * * *